US009277314B2

(12) United States Patent
Kim

(10) Patent No.: US 9,277,314 B2
(45) Date of Patent: Mar. 1, 2016

(54) METHOD AND APPARATUS FOR REDUCING CURRENT CONSUMPTION OF MOBILE TERMINAL

(75) Inventor: Tae Seon Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1176 days.

(21) Appl. No.: 13/228,077

(22) Filed: Sep. 8, 2011

(65) Prior Publication Data

US 2012/0201401 A1 Aug. 9, 2012

(30) Foreign Application Priority Data

Feb. 7, 2011 (KR) ..... 10-2011-0010424

(51) Int. Cl.
*H04R 1/10* (2006.01)
*H04R 3/00* (2006.01)
*H04R 29/00* (2006.01)

(52) U.S. Cl.
CPC ..... *H04R 3/00* (2013.01); *H04R 29/004* (2013.01)

(58) Field of Classification Search
CPC ..... H04R 1/1041; H04R 3/00; H04R 5/033; H04M 1/6058
USPC ..... 381/375, 74, 122; 379/448
See application file for complete search history.

(56) References Cited

U.S. PATENT DOCUMENTS 5,832,075 A * 11/1998 Gancarcik ..... 379/377
2005/0164631 A1 7/2005 Jin
2009/0180643 A1* 7/2009 Sander et al. ..... 381/111
2010/0054518 A1* 3/2010 Goldin ..... 381/370

FOREIGN PATENT DOCUMENTS

KR 10-2005-0076845 A 7/2005

* cited by examiner

*Primary Examiner* — Alexander Jamal
(74) *Attorney, Agent, or Firm* — Jefferson IP Law, LLP

(57) ABSTRACT

A method and an apparatus for reducing current consumption in a mobile terminal are provided. The mobile terminal includes a power supply unit for outputting a paging power signal that repeats power on and off states and a microphone bias according to a paging period previously set by a network, a connection unit for connecting the peripheral device and for outputting a connection detecting signal when connection of the peripheral device is detected, a determination unit for receiving the paging power signal and the connection detecting signal as an input signal and for generating and outputting a microphone bias apply signal when a power on state of the paging power signal is detected, and a controller for controlling application of the microphone bias apply signal to the connection unit when the controller receives the microphone bias apply signal.

17 Claims, 8 Drawing Sheets

METHOD AND APPARATUS FOR REDUCING CURRENT CONSUMPTION OF MOBILE TERMINAL

PRIORITY

This application claims the benefit under 35 U.S.C. §119 (a) of a Korean patent application filed on Feb. 7, 2011 in the Korean Intellectual Property Office and assigned Serial No. 10-2011-0010424, the entire disclosure of which is hereby incorporated by reference.

BACKGROUND OF THE INVENTION

1. Field of the Invention

The present invention relates to a method and an apparatus for reducing current consumption in a mobile terminal. More particularly, the present invention relates to a method for reducing current consumption in a mobile terminal capable of connecting with a four-pole plug ear microphone accessory having a call button, and an apparatus thereof.

2. Description of the Related Art

Recently, a mobile terminal has been developed into a multi-media device capable of providing various additional services such as an electronic book function, a game function, and a schedule management function. Accordingly, the mobile terminal connects with various peripheral devices and has extended its functions to a music listening function, a movie watching function, and a photographing function. In general, the mobile terminal includes a jack interface for connecting with other peripheral devices. A plug of a peripheral device such as a speaker, an ear microphone, and a headset is connected to the jack interface. Examples of the plug of a peripheral device may include a three-pole plug with a three-pole access point or a four-pole plug with a four-pole access point.

In a case of an ear microphone with a four-pole plug, the four-pole plug includes a microphone terminal to which DC power is applied and a button executing a call (SEND/END) function to perform phone reception and termination functions upon reception of a phone call. In this case, because the button executing the call function is connected between a microphone terminal and a ground terminal of the four-pole plug, a microphone bias should be applied to the microphone terminal to detect the presence of an operation of the button.

In the related art, to detect the presence of an operation of the button regardless of an idle state or a call connection state of a mobile terminal, a microphone bias should be continuously applied to a microphone terminal. However, the continuous application of the microphone bias causes unnecessary consumption in the mobile terminal.

SUMMARY OF THE INVENTION

Aspects of the present invention are to address at least the above-mentioned problems and/or disadvantages and to provide at least the advantages described below. Accordingly, an aspect of the present invention is to provide a method for reducing current consumption in a mobile terminal capable of connecting with a four-pole plug ear microphone accessory having a function button, and an apparatus thereof.

Another aspect of the present invention is to further provide a method for reducing current consumption in a mobile terminal by receiving a paging power signal and a connection detecting signal for a four-pole plug ear microphone as an input signal to apply a microphone bias to a microphone terminal when the portable terminal connects with the four-pole plug ear microphone simultaneously with a power on state of the paging power signal, and an apparatus thereof.

In accordance with an aspect of the present invention, a mobile terminal connecting with a peripheral device is provided. The method includes a power supply unit for outputting a paging power signal that repeats power on and off states and a microphone bias according to a paging period previously set by a network, a connection unit for connecting the peripheral device and for outputting a connection detecting signal when connection of the peripheral device is detected, a determination unit for receiving the paging power signal and the connection detecting signal as an input signal and for generating and outputting a microphone bias apply signal when a power on state of the paging power signal is detected, and a controller for controlling application of the microphone bias apply signal to the connection unit when the controller receives the microphone bias apply signal.

In accordance with another aspect of the present invention, a method for reducing current consumption in a mobile terminal connecting with a peripheral device through a connection unit is provided. The method includes receiving a paging power signal that repeats power on and off states and a microphone bias according to a paging period previously set by a network, determining whether the mobile terminal connects with the peripheral device, and applying a microphone bias to the connection unit when the portable terminal connects with the peripheral device simultaneously with a power on state of the paging power signal.

A mobile terminal according to exemplary embodiments of the present invention receives a paging power signal and a four-pole plug ear microphone connection detecting signal to apply a microphone bias to a microphone terminal when the portable terminal connects with the four-pole plug ear microphone simultaneously with a power on state of the paging power signal. Accordingly, unnecessary current consumption may be reduced in the mobile terminal.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

FIGS. 1 through 8, discussed below, and the various exemplary embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the invention. Terms first, second, and the like are used to differentiate between objects having the same terminology and are in no way intended to represent a chronological order, unless where explicitly stated otherwise. A set is defined as a non-empty set including at least one element.

Figure 1:
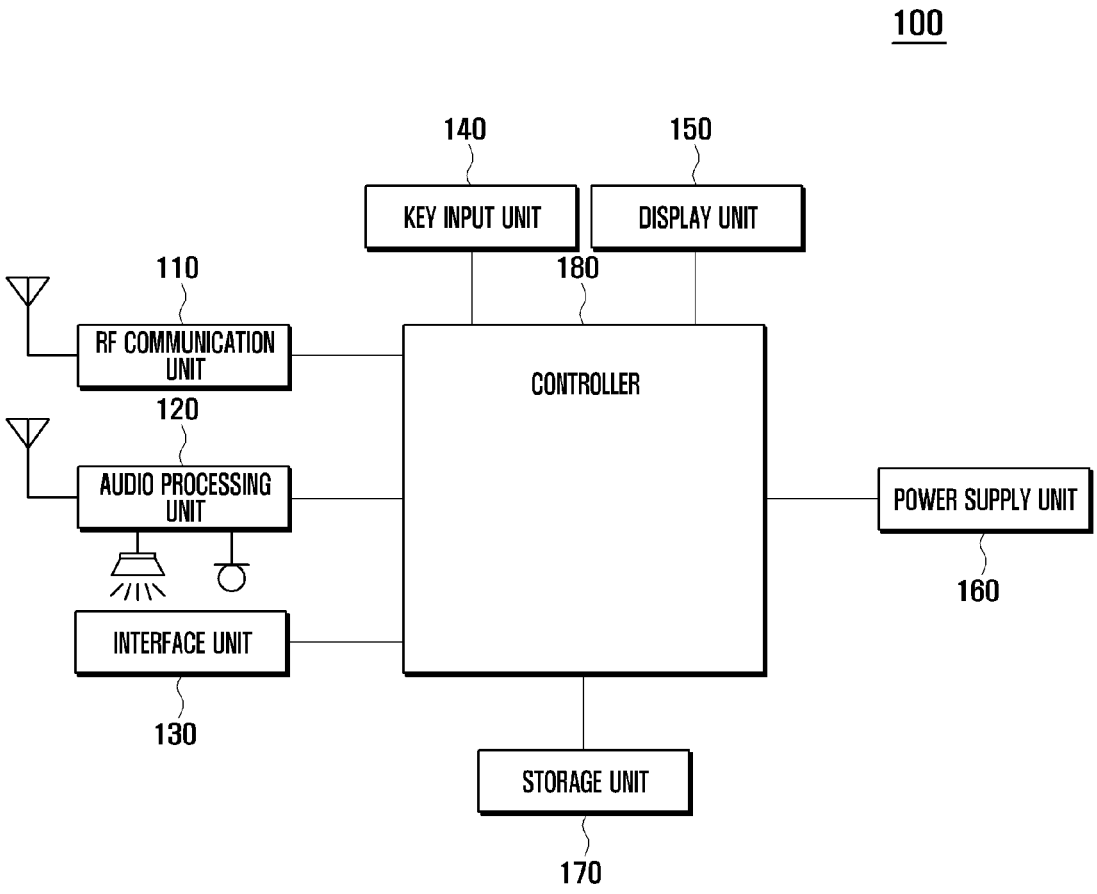
FIG. 1 is a block diagram illustrating a configuration of a mobile terminal according to an exemplary embodiment of the present invention.

FIG. 1 is a block diagram illustrating a configuration of a mobile terminal according to an exemplary embodiment of the present invention. FIG. 1 illustrates a structure of a mobile terminal 100 according to an exemplary embodiment of the present invention. FIG. 2 to FIG. 5 illustrate a detailed internal structure of the mobile terminal 100 according to an exemplary embodiment of the present invention.

Referring to FIG. 1, a mobile terminal according to an exemplary embodiment of the present invention includes a Radio Frequency (RF) unit 110, an audio processing unit 120, an interface unit 130, a key input unit 140, a display unit 150, a power supply unit 160, a storage unit 170, and a controller 180.

The RF communication unit 110 executes transmitting and receiving functions of corresponding data for RF communication of the mobile terminal 100. The RF communication unit 110 may include an RF transmitter for up-converting a frequency of a transmitted signal and for amplifying the signal, and an RF receiver for low-noise-amplifying a received signal and for down-converting the signal. Further, the RF communication unit 110 may receive and output data through an RF channel to the controller 180, and transmit data output from the controller 180 through the RF channel.

The audio processing unit 120 may be configured by a CODEC. The CODEC may be configured with a data CODEC for processing packet data and an audio CODEC for processing an audio signal such as speech. The audio processing unit 120 converts a digital audio signal into an analog audio signal through an audio CODEC and plays the analog audio signal through a Speaker (SPK). The audio processing unit converts an analog audio signal input from a Microphone (MIC) into a digital audio signal.

The interface unit 130 is a connection unit between a peripheral device and the mobile terminal 100. In an exemplary implementation, when the peripheral device is an ear microphone, a plug of the ear microphone is inserted into the interface 130 to connect the ear microphone with the mobile terminal 100. In this case, there are various plugs including a three-pole plug with a three-pole access point and a four-pole plug with a four-pole access point as examples of the plug of a peripheral device. However, it is assumed herein that a plug of the peripheral device is a four-pole plug. That is, hereinafter, it is assumed that a peripheral device is an ear microphone with a four-pole plug.

The key input unit 140 receives a key operation of a user for controlling the mobile terminal 100, and generates and transfers an input signal to the controller 160. The key input unit 140 may be configured by a key pad including a numeral key and an arrow key. The key input unit 140 may be configured by a preset function key provided at one side of the mobile terminal 100.

The display unit 150 may be configured by a Liquid Crystal Display (LCD), Organic Light Emitting Diodes (OLEDs), or Active Matrix Organic Light Emitting Diodes (AMOLEDs). The display unit 150 provides a menu of the mobile terminal 100, input data, function setting information, and various other information to a user. The display unit 150 executes a function for outputting a booting screen, an idle screen, a menu screen, a call screen, and other application screens of the mobile terminal 100.

The power supply unit 160 supplies power necessary for execution of driving and functions of the mobile terminal 100 to respective function blocks. In general, the power supply unit 160 receives power from a portable battery.

The storage unit 170 stores programs and data necessary for an operation of the mobile terminal 100. The storage unit 170 may be divided into a program area and a data area. The program area may store a program for controlling an overall operation of the mobile terminal 100, an Operating System (OS) for booting the mobile terminal 100, an application program necessary for playing multimedia contents, and application programs necessary for other optional functions such as a camera function, a sound playing function, image or moving image playing function. Data created according to use of the mobile terminal 100 are stored in a data area. Images, moving images, phone-books, and audio data may be stored in the data area.

More particularly, the storage unit 170 according to an exemplary embodiment of the present invention may receive a paging power signal and a four-pole plug ear microphone connection detecting signal. The storage unit 170 applies a microphone bias to a microphone terminal when the portable terminal connects with the four-pole plug ear microphone simultaneously with a power on state of the paging power signal, thereby storing a program for reducing current consumption of the mobile terminal.

The controller 180 controls an overall operation with respect to respective structural elements of the mobile terminal. The controller 180 detects the presence of a peripheral device connection. When connection of the peripheral device is detected, the controller 180 determines the type of connected peripheral device and controls the peripheral device according to the determined result.

The controller 180 receives a paging power signal and a four-pole plug ear microphone connection detecting signal according to an exemplary embodiment of the present invention and applies a microphone bias to a microphone terminal when the portable terminal connects with the four-pole plug ear microphone simultaneously with a power on state of the paging power signal. Further, in an exemplary embodiment of the present invention, when a call connection event or a record event occurs, the controller 180 may control to supply the microphone bias to a microphone terminal.

Figure 2:
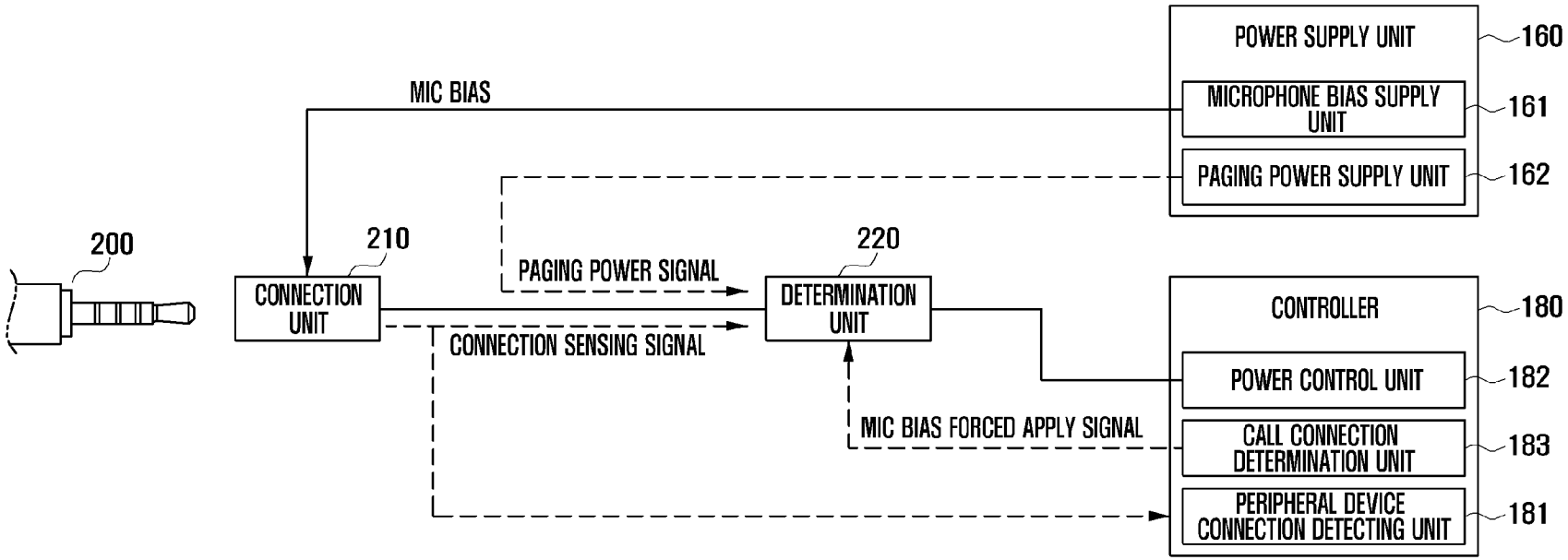
FIG. 2 is a block diagram illustrating connection constructions and signal flow between an interface unit, a power supply unit, and a controller among internal constructions of a mobile terminal according to an exemplary embodiment of the present invention.

FIG. 2 is a block diagram illustrating connection constructions and signal flow between an interface unit, a power supply unit, and a controller among internal constructions of a mobile terminal according to an exemplary embodiment of the present invention.

Referring to FIG. 2, the interface unit 130 may include a connection unit 210 and a determination unit 220. The connection unit 210 is an access point in which the four-pole plug ear microphone 200 and the mobile terminal 100 are connected to each other. When the connection unit 210 detects the connection of the four-pole plug ear microphone, it outputs a connection detecting signal to the determination unit 220 and the controller 180.

Figure 3:
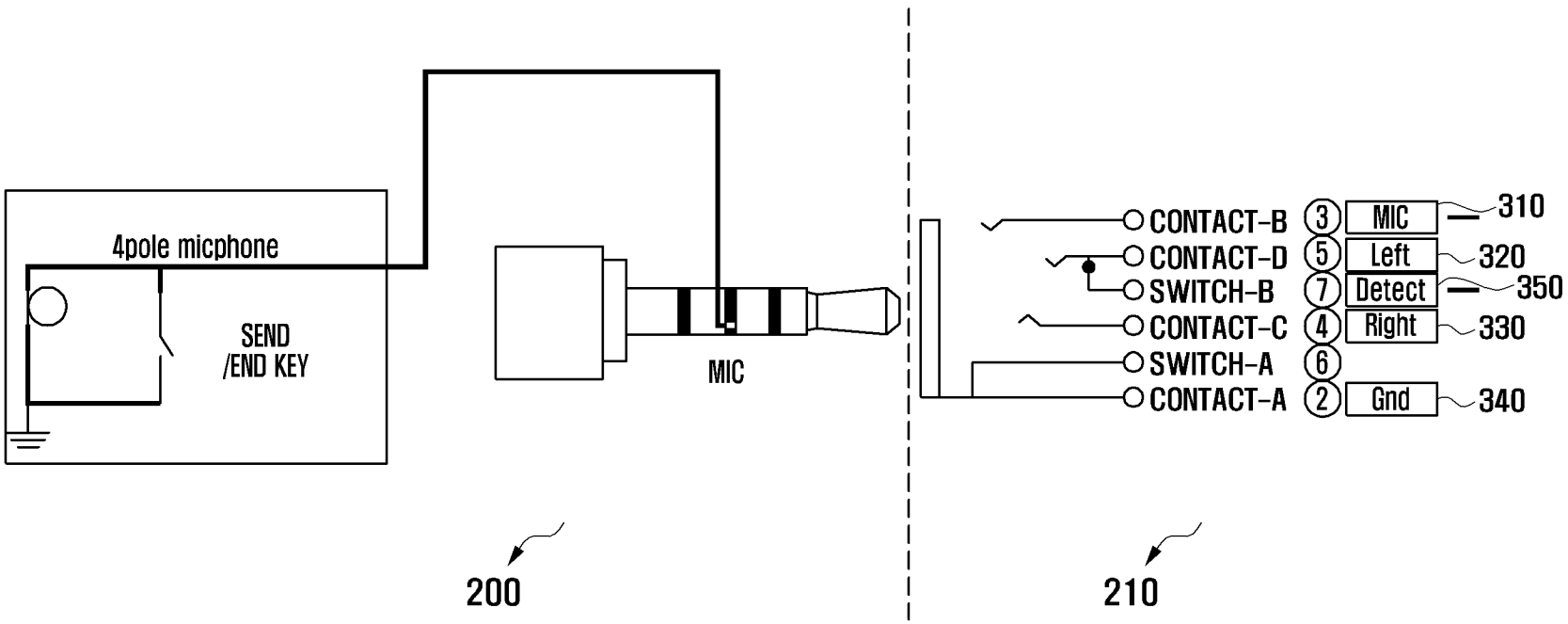
FIG. 3 is a view illustrating a previous state before connection between a four-pole plug ear microphone and a connection unit according to an exemplary embodiment of the present invention.

FIG. 3 is a view illustrating a previous state before connection between a four-pole plug ear microphone and a connection unit according to an exemplary embodiment of the present embodiment.

Referring to FIG. 3, the four-pole plug ear microphone 200 connects with the mobile terminal 100 through the connection unit 210. The four-pole ear microphone 200 includes a button executing a call and functions of the mobile terminal 100. The button is connected to a microphone terminal of the four-pole plug ear microphone 200.

Further, a connection unit of the mobile terminal 100 includes four terminals, namely, a microphone terminal 310, a left sound terminal 320, a right sound terminal 330, and a ground terminal 340. Each terminal of the connection unit 210 connects with a corresponding terminal of the four-pole plug ear microphone 200. For example, the microphone terminal 310 of the connection unit 210 connects with a microphone terminal of the four-pole plug ear microphone 200. A left sound terminal 320 of the connection unit 210 connects with a left sound terminal of the four-pole plug ear microphone 200.

As illustrated in FIG. 3, the connection unit 210 detects the connection of the four-pole plug ear microphone 200 and outputs a connection detecting signal 350 to the determination unit 220 and the controller 180. The connection detecting signal output to the determination unit 220 is used as a reference input signal for determining the presence of a microphone bias. The connection detecting signal output to the controller 180 is used as a signal for determining the type of connected peripheral device.

Referring back to FIG. 2, when connection of the four-pole plug ear microphone 200 is detected, the determination unit 220 determines whether to apply a microphone bias to the microphone terminal of the connection unit 210. To this end, the determination unit 220 receives a connection detecting signal provided from the connection unit 210 and a paging power signal provided from the power supply unit 160 as an input signal and determines whether to apply a microphone bias to a microphone terminal 310. The paging power signal is a signal that repeats power on/off states according to a paging period.

In more detail, only when the connection detecting signal is applied and power of the paging power signal is on, the determination unit 220 may generate and output a microphone bias apply signal to a controller 180 to apply a microphone bias to the microphone terminal 310. In a state when the four-pole plug ear microphone 200 connects with the mobile terminal 100, the determination unit 220 applies a microphone bias to the microphone terminal 310 only when power of the paging power signal is on.

Exemplary embodiments of the present invention may efficiently reduce current consumption in comparison with the related art. In this case, the related art supplies a microphone bias to the microphone terminal 310 regardless of a state of the mobile terminal 100.

In the meantime, a determination unit 220 may determine whether a microphone bias forced apply signal is input. The reason why the microphone bias forced apply signal is required is described in more detail below.

When the mobile terminal 100 is switched from an idle state to a call state, input of a paging power signal from a power supply unit 160 stops. Accordingly, the paging power signal input to the determination unit 22 is cut-off to amplify RF power in a call state of the mobile terminal 100. Consequently, since power of the paging power signal input to the determination unit 22 is off in the call state of the mobile terminal 100, there is a need for a separate signal capable of applying a microphone bias to the microphone terminal 310.

In an exemplary implementation, when a record event occurs in the mobile terminal 100, the microphone bias should always be applied to the microphone terminal 310 regardless of the power on/off state of the paging power signal to continuously execute the record function. Although the record event occurs, if the microphone bias is applied according to the power on/off state of the paging power signal, a record stop phenomenon may occur according to a paging period.

For this reason, when a call event or a record event occurs in the mobile terminal 100, the determination unit 220 may receive a microphone bias forced apply signal from the controller 180. Upon receiving the microphone bias forced apply signal, the determination unit 220 applies the microphone bias to the microphone terminal 310.

As illustrated in FIG. 2, the power supply unit 160 may include a microphone bias supply unit 161 and a paging power supply unit 162.

Upon receiving a microphone bias supply command from the controller 180, the microphone bias supply unit 161 applies the microphone bias to the microphone terminal 310 of the connection unit 210. In an exemplary implementation, the microphone bias may be Low Drop Out (LDO). Linear regulator means a device that removes an excessive voltage from a constant voltage using a transistor or a Field Effect Transistor (FET) operating within a linear area to generate a desired output voltage.

Figure 7:
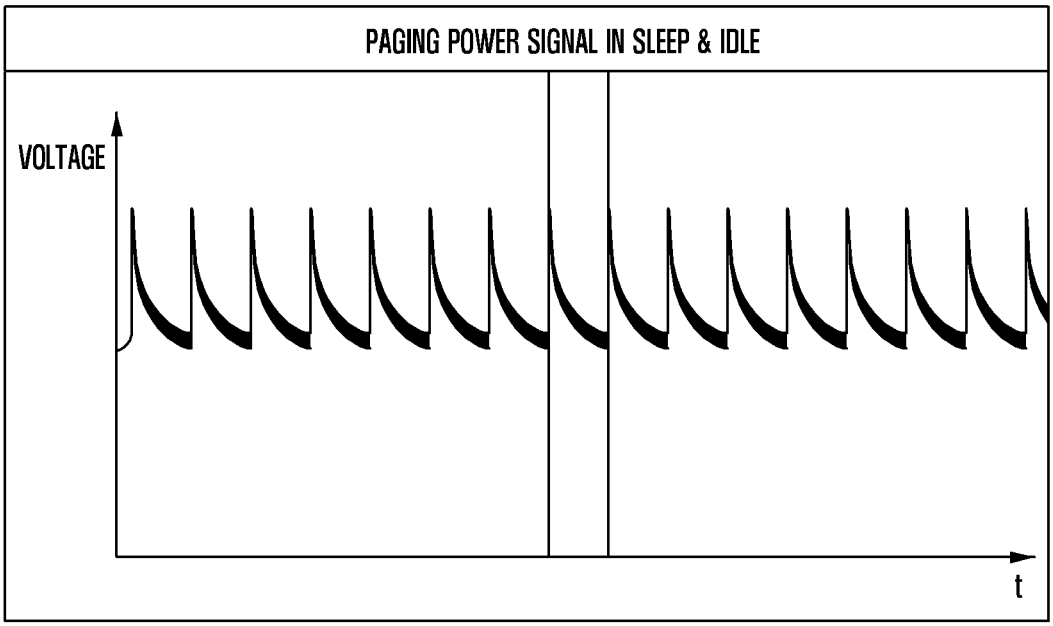
FIG. 7 and FIG. 8 are views illustrating a paging power signal generated by a paging power supply unit according to exemplary embodiments of the present invention.
Figure 8:
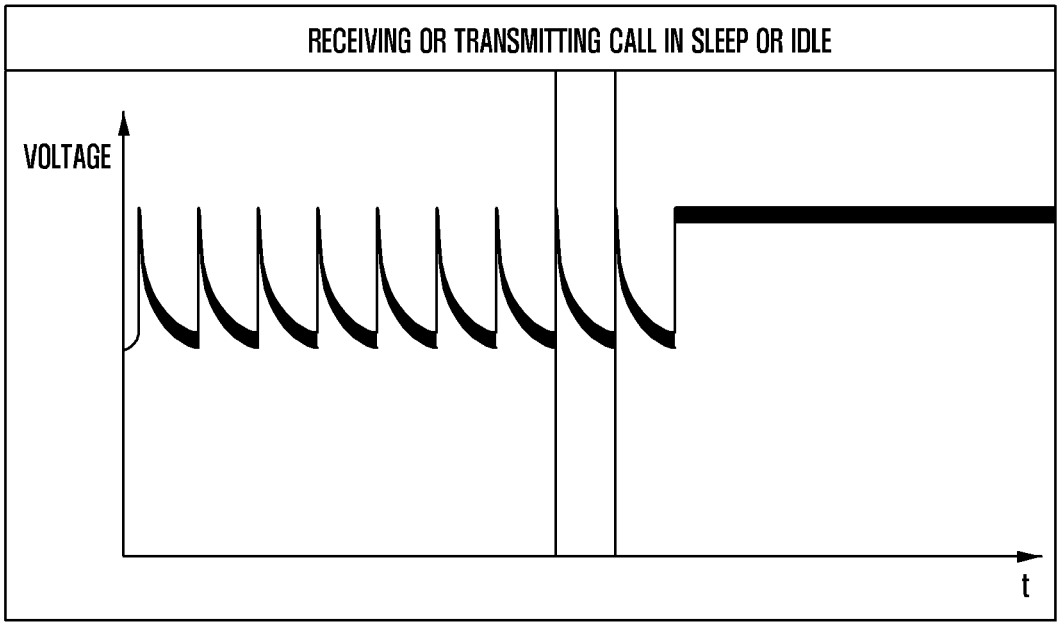

The paging power supply unit 161 generates a paging power signal being periodically on/off according to a paging period set between the mobile terminal 100 and a network. Further, the paging power supply unit 161 provides the generated paging power signal to the determination unit 220. FIG. 7 and FIG. 8 are views illustrating a paging power signal generated by a paging power supply unit 161 according to exemplary embodiments of the present invention.

FIG. 7 is a view illustrating an example of a paging power signal generated by a paging power supply unit in an idle state of the mobile terminal according to an exemplary embodiment of the present invention.

Referring to FIG. 7, the paging power signal repeats on and off states according to the paging period set between the mobile terminal 100 and the network.

FIG. 8 is a view illustrating an example of a paging power signal generated by a paging power supply unit when a mobile terminal is switched from an idle state to a call state according to an exemplary embodiment of the present invention.

Referring to FIG. 8, the paging power signal repeats on and off states according to a paging period in an idle state of the mobile terminal 100. Meanwhile, when the mobile terminal 100 is switched from the idle state to the call state, the paging power signal continuously maintains an on state.

As illustrated in FIG. 1, the controller 180 receives a paging power signal and a four-pole plug ear microphone connection detecting signal to apply a microphone bias to a microphone terminal only when the portable terminal 100 connects with the four-pole plug ear microphone simultaneously with a power on state of the paging power signal. To this end, the controller 180 may include a peripheral device connection detecting unit 181, a power control unit 182, and a call connection determination unit 183.

The peripheral device connection detecting unit 181 receives a connection detecting signal from the connection unit 210. Accordingly, the peripheral device connection detecting unit 181 detects the type of peripheral device connecting with the mobile terminal 100 through a peripheral device recognition algorithm.

Upon receiving a microphone bias apply signal from the determination unit 220, the power control unit 182 controls the microphone bias supply unit 161 of the power supply unit 160 to supply the microphone bias to the microphone terminal 310. When a call event of the mobile terminal 100 occurs, the power control unit 182 may control cutting-off the paging power applied to the determination unit 220. This is performed to secure performance with respect to RF characteristics of the mobile terminal 100.

The call connection determination unit 183 determines whether a call event occurs in the mobile terminal 100. When the call event occurs, the call connection determination unit 183 generates and provides a microphone bias forced apply signal to the determination unit 220. The microphone bias forced apply signal causes a microphone bias to be applied to the microphone terminal 310 regardless of the power on/off state of the paging power signal. The foregoing exemplary embodiment of the present invention has been described in that the microphone bias forced apply signal is generated at the occurrence time of the call event. However, the same principle is applicable at the occurrence time of a record event.

In the meantime, the peripheral device connection detecting unit 181, the power control unit 182, and the call connection determination unit 183 are configured in FIG. 2 as separate blocks, and the respective blocks perform different functions. This arrangement is for convenience of description but respective functions are not distinguished. For example, the controller 180 may execute a certain function executed by the power control unit 182.

Figure 4:
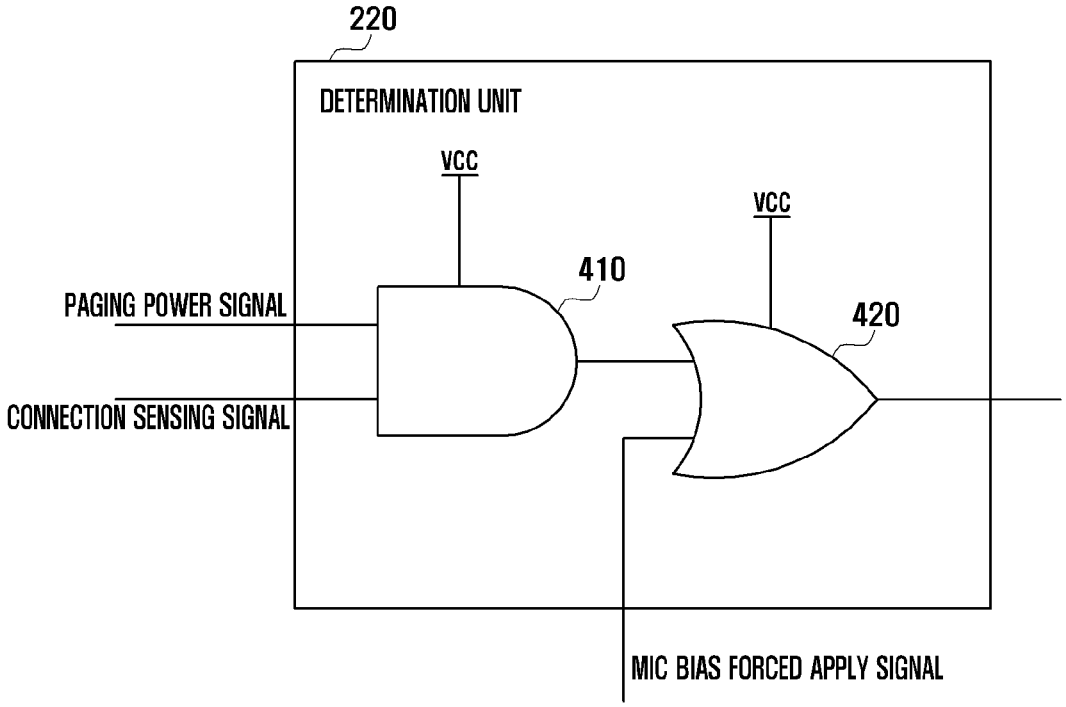
FIG. 4 is a view illustrating an internal construction of a determination unit according to an exemplary embodiment of the present invention.

FIG. 4 is a view illustrating an internal construction of a determination unit according to an exemplary embodiment of the present invention.

Referring to FIG. 4, the determination unit 220 includes an AND gate 410. According to an exemplary embodiment of the present invention, the determination unit 220 may further include an OR gate 420.

The AND gate 410 includes two input terminals. The paging power signal provided from the paging power supply unit 162 and the connection detecting signal provided from the connection unit 210 are applied to each of the input terminals of the AND gate 410. The connection detecting signal is input to the AND gate 410 only when a four-pole plug ear microphone 200 connects with the connection unit 210. Meanwhile, the paging power signal repeats power on and power off state according to a paging period. Accordingly, only when a power on signal of the connection detecting signal or a power on signal of the paging power signal are simultaneously input (namely, two input signals are high), the AND gate 410 generates and outputs the microphone bias apply signal.

The output microphone bias apply signal is provided to the power control part 182 according to an exemplary embodiment of the present invention. Accordingly, the power control unit 182 controls the microphone bias supply unit 161 to apply a microphone bias to a microphone terminal 310 of the connection unit 210.

In another exemplary implementation, the microphone bias signal may be applied as an input signal of the OR gate 420.

The OR gate 420 includes two input terminals. A microphone bias apply signal output from the AND gate 410 and a microphone bias forced apply signal output from the call connection determination unit 183 are applied to each of the input terminals of the OR gate 420. When at least one of the microphone bias apply signal or the microphone bias forced apply signal is input to the OR gate 420 (namely, at least one signal is high), it generates and outputs a microphone bias apply output signal.

The output of the microphone bias apply output signal is provided to the power control unit 182 according to an exemplary embodiment of the present invention. Accordingly, the power control unit 182 controls the microphone bias supply unit 161 to apply the microphone bias to the microphone terminal 310 of the connection unit 210.

In the meantime, FIG. 4 illustrates an AND gate as a logic circuit for outputting a microphone bias apply signal. However, the present invention is not limited thereto. For example, the NOR gate may be used as the logic circuit. That is, a circuit having a high output in only one among four (4) possible numbers (00, 01, 10, 11) may be used instead of the AND gate of FIG. 4.

FIG. 4 illustrates an OR gate as a logic circuit for outputting a microphone bias apply output signal. However, the present invention is not limited thereto. For example, the logic circuit may be implemented by a wired-OR through a diode. The wired-OR combines an output thereof by externally connected separate circuits or functions to obtain a function of OR. The OR gate operates in such a way that its output is logic '1' if one or both of two inputs are at logic '1'.

Figure 5:
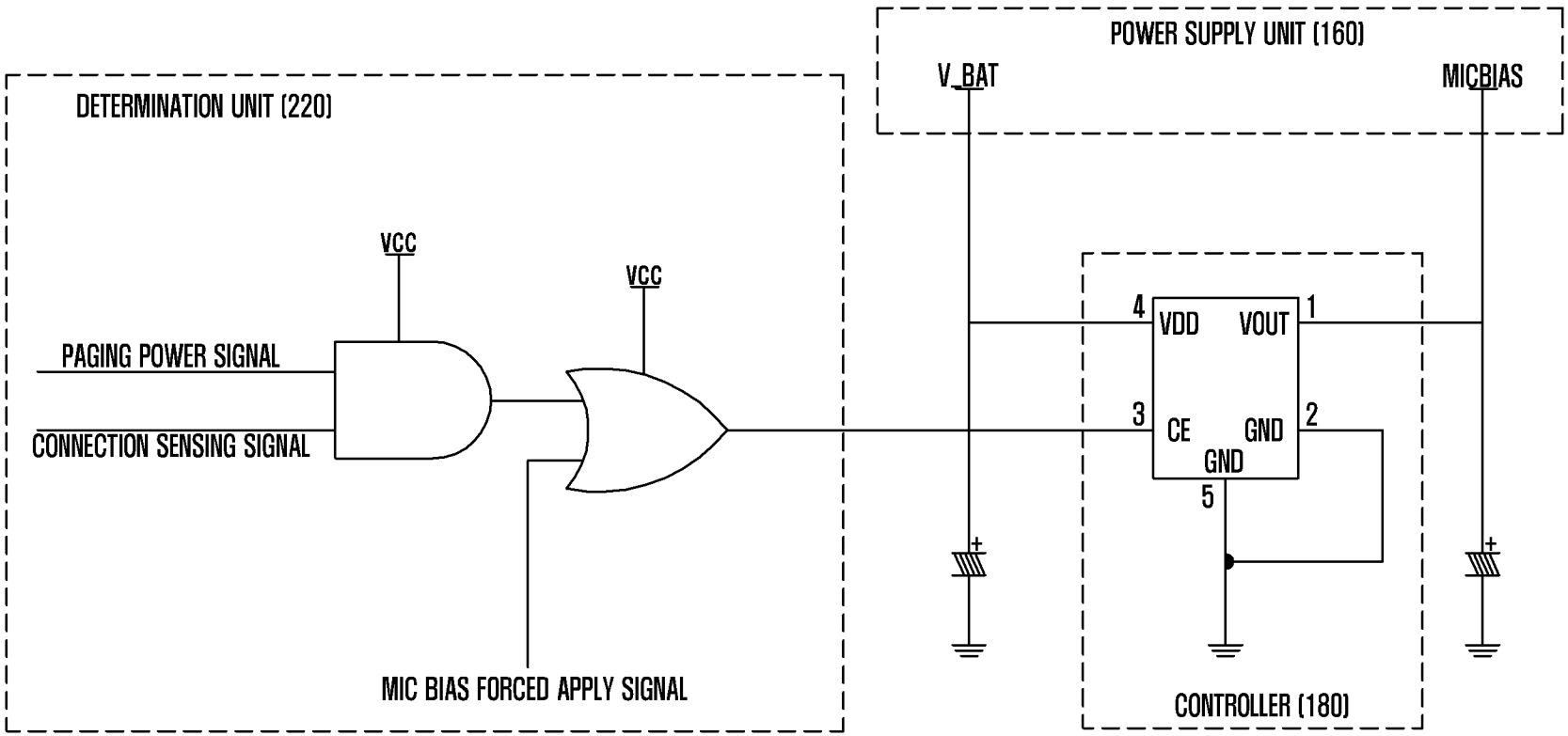
FIG. 5 is a circuitry diagram illustrating connected structures between the determination unit, a power supply unit, and a controller according to an exemplary embodiment of the present invention.

FIG. 5 is a circuitry diagram illustrating connected structures between a determination unit, a power supply unit, and a controller according to an exemplary embodiment of the present invention.

Referring to FIG. 5, when a four-pole plug ear microphone 200 connects with a mobile terminal 100, a connection detecting signal is provided to an AND gate 410. When power of a paging power signal provided to the AND gate 410 is on, it outputs a microphone bias apply signal. The microphone bias apply signal is input to a Chip Enable (CE) 3 of a controller 180 directly or through an OR gate 420. Accordingly, the controller 180 outputs a control signal for enabling a microphone bias through an output terminal 1. Consequently, the microphone bias is applied to a microphone terminal 310.

In an exemplary implementation, an expected consumption current and a battery use time according to an Extended Global System for Mobile Communication (EGSM) multiframe paging period are illustrated in Table 1. A mobile terminal of a 3.5 mm four-pole ear phone dedicated model is used and a battery of 1500 mAh capacity is mounted. In the related art, consumption current due to a microphone bias that is always on is 3.04 mA and may wait for 494 hours. When an exemplary embodiment of the present invention is applied, it is appreciated that current consumption is reduced as illustrated in Table 1.

TABLE 1

| Multiframe P/P | 2 | 3 | 4 | 5 | 6 | 7 |
|---|---|---|---|---|---|---|
| Period | 470 ms | 942 ms | 1.18 s | 1.416 s | 1.652 s | 1.888 s |
| Reduced current | 0.732 mA | 0.766 mA | 0.773 mA | 0.777 mA | 0.781 mA | 0.783 mA |
| Consumption current | 2.308 mA | 2.274 mA | 2.267 mA | 2.263 mA | 2.269 mA | 2.257 mA |
| Expected waiting time | 650 h | 659.6 h | 661.6 h | 662.9 h | 663.9 h | 664.6 h |

Figure 6:
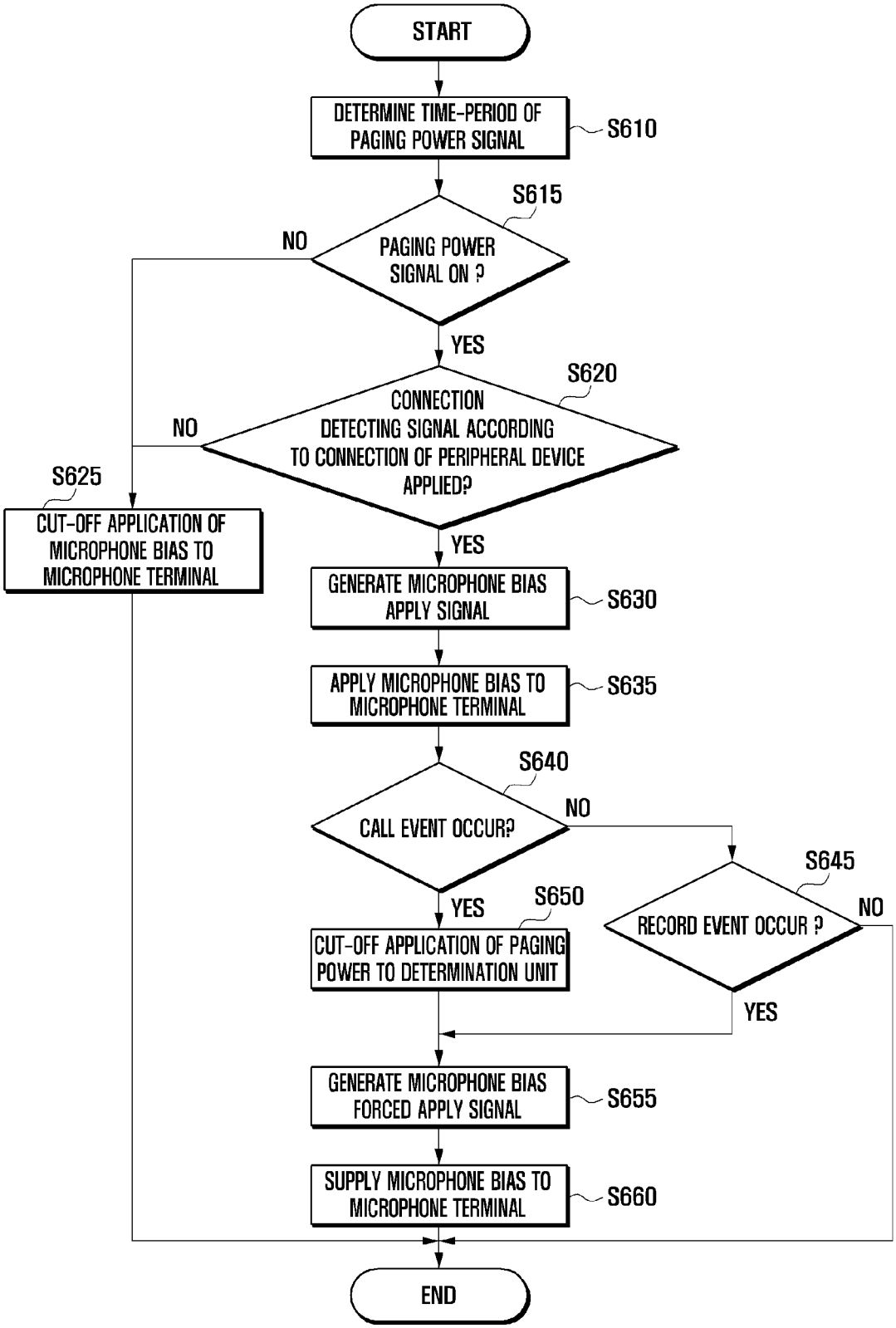
FIG. 6 is a flowchart illustrating a microphone bias applying method according to an exemplary embodiment of the present invention.

FIG. 6 is a flowchart illustrating a microphone bias applying method according to an exemplary embodiment of the present invention.

Referring to FIG. 6, a determination unit 220 determines a time-period of a provided paging power signal in step S610. As illustrated above, the paging power signal repeats power on and off states according to a paging period previously set by a network. Next, the determination unit 220 determines whether power of the paging power signal is on in step S615. When the power of the paging power signal is on, the determination unit 220 determines whether a connection detecting signal is applied according to connection of a peripheral device (namely, four-pole plug ear microphone) in step S620. When the power of the paging power signal is off, a microphone bias apply signal to a microphone terminal is cut off in step S625.

When the connection detecting signal is applied, the determination unit 220 generates a microphone bias apply signal for controlling a power supply unit in step S630. In more detail, the generated microphone bias apply signal is input to the power control unit 182. Accordingly, the power control unit 182 controls a microphone bias supply unit 161 to apply a microphone bias to a microphone terminal 310 in step S635.

Next, a call connection determination unit 183 determines whether a call event occurs in step S640. When the call event occurs, the call connection determination unit 183 cuts-off application of paging power to the determination unit 220 in step S650. This is performed to secure performance with respect to RF characteristics of the mobile terminal at the time of a call. When the call event does not occur, the call connection determination unit 183 determines whether a record event occurs in step S645.

When the call event or the record event occurs, the call connection determination unit 183 generates and outputs a microphone bias forced apply signal to the determination unit 220 in step S655.

Subsequently, the determination unit 220 generates a microphone bias apply signal for supplying a microphone bias to the microphone terminal 310 in step S660. In more detail, the generated microphone bias apply signal is input to the power control unit 182. Accordingly, the power control unit 182 controls a microphone bias supply unit 161 to apply a microphone bias to a microphone terminal 310 in step S635.

The mobile terminal 100 according to exemplary embodiments of the present invention receives a paging power signal and a four-pole plug ear microphone connection detecting signal and applies a microphone bias to a microphone terminal when the portable terminal connects with the four-pole plug ear microphone simultaneously with power on of the paging power signal. Accordingly, unnecessary current consumption in a mobile terminal may be reduced.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A mobile terminal connecting with a peripheral device, the mobile terminal comprising:

a power supply unit configured to output a paging power signal that repeats power on and off states and a microphone bias according to a paging period previously set by a network;

a connection unit configured to:

connect the peripheral device, and output a connection detecting signal when connection of the peripheral device is detected, wherein the connection unit includes a microphone terminal, a first sound terminal, a second sound terminal, and a ground terminal;

a determination unit configured to:

receive the paging power signal and the connection detecting signal as an input signal, and generate and output a microphone bias apply signal when a power on state of the paging power signal is detected and the connection of the peripheral device is detected; and a controller configured to control application of the microphone bias apply signal to the microphone terminal of the connection unit when the controller receives the microphone bias apply signal.

2. The mobile terminal of claim 1, wherein the controller is further configured to determine whether at least one of a call event and a record event of the mobile terminal occurs, and generate and output a microphone bias forced apply signal to the determination unit when the at least one of the call event and the record event of the mobile terminal occurs.

3. The mobile terminal of claim 2, wherein the determination unit is further configured to generate and output the microphone bias apply signal to the controller regardless of the presence of the power on state of the paging power signal when the determination unit receives the microphone bias forced apply signal.

4. The mobile terminal of claim 3, wherein the power supply unit is further configured to stop applying the paging power signal to the connection unit when the call event occurs.

5. The mobile terminal of claim 4, wherein the connection unit comprises a microphone terminal, a left sound terminal, a right sound terminal, and a ground terminal.

6. The mobile terminal of claim 5, wherein the power supply unit is further configured to apply the microphone bias to the microphone terminal.

7. The mobile terminal of claim 6, wherein the determination unit comprises an AND gate configured to:

receive the paging power signal and the connection detecting signal as an input signal, and generate and output a microphone bias apply signal when the power on state of the paging power signal is detected.

8. The mobile terminal of claim 7, wherein the determination unit further comprises an OR gate configured to:

receive the microphone bias apply signal and the microphone bias forced apply signal as an input signal, and output a microphone bias apply output signal when the OR gate receives at least one of the microphone bias apply signal or the microphone bias forced apply signal.

9. The mobile terminal of claim 1, wherein the peripheral device comprises a four-pole plug ear microphone.

10. A method for reducing current consumption in a mobile terminal connecting with a peripheral device through a connection unit including a microphone terminal, a first sound terminal, a second sound terminal, and a ground terminal, the method comprising:

receiving a paging power signal that repeats power on and off states and a microphone bias according to a paging period previously set by a network;

determining whether the mobile terminal connects with the peripheral device; and applying a microphone bias to the microphone terminal of the connection unit when the portable terminal connects with the peripheral device simultaneously with a power on state of the paging power signal.

11. The method of claim 10, further comprising:

determining whether at least one of a call event and a record event occurs in the mobile terminal; and applying the microphone bias to the connection unit when the at least one of the call event and the record event occurs.

12. The method of claim 11, further comprising generating and outputting a microphone bias forced signal to the connection unit when the at least one of the call event and the record event of the mobile terminal occurs.

13. The method of claim 12, further comprising generating and outputting a microphone bias signal to the controller regardless of the presence of the power on state of the paging power signal when the connection unit receives the microphone bias forced signal.

14. The method of claim 11, further comprising stopping application of the paging power signal to the connection unit when the call event occurs.

15. The method of claim 14, wherein the connection unit comprises a microphone terminal, a left sound terminal, a right sound terminal, and a ground terminal.

16. The method of claim 15, wherein the microphone bias is applied to the microphone terminal.

17. The method of claim 10, wherein the peripheral device comprises a four-pole plug ear microphone.

* * * * *